US006951212B1

(12) United States Patent
Ho et al.

(10) Patent No.: US 6,951,212 B1
(45) Date of Patent: Oct. 4, 2005

(54) SHOCK PAD FOR PAINTBALL POD

(75) Inventors: Eden Siu-Ki Ho, Sunnyvale, CA (US); Li-King Yee, Fremont, CA (US)

(73) Assignee: Nexpro, Inc., Fremont, CA (US)

( * ) Notice: Subject to any disclaimer, the term of this patent is extended or adjusted under 35 U.S.C. 154(b) by 0 days.

(21) Appl. No.: 10/893,616

(22) Filed: Jul. 16, 2004

Related U.S. Application Data

(60) Provisional application No. 60/488,077, filed on Jul. 16, 2003.

(51) Int. Cl.[7] ..... F41B 11/02

(52) U.S. Cl. ..... 124/45; 206/521

(58) Field of Search ..... 124/45, 49; 206/315.9, 206/521, 523

(56) References Cited

U.S. PATENT DOCUMENTS 3,063,549 A * 11/1962 Weichselbaum ..... 206/456
3,120,319 A * 2/1964 Buddrus ..... 215/12.2
3,826,358 A * 7/1974 Butler et al. ..... 206/204
4,872,563 A * 10/1989 Warder et al. ..... 53/471
5,018,621 A * 5/1991 O'Connell, Jr. ..... 206/204
5,160,021 A * 11/1992 Sibley et al. ..... 206/204

* cited by examiner

*Primary Examiner*—John A. Ricci
(74) *Attorney, Agent, or Firm*—David T. Millers

(57) ABSTRACT

A paintball carrying and loading device or pod includes a cushion to avoid rattling, impact, and breaking of paintballs when the device is carried on a field of play. The device generally includes a tube, a lid, and the cushion. The cushion can be removable or attached to the lid or to a closed end of the tube. A second cushion can provide cushioning at the other end of the tube.

18 Claims, 2 Drawing Sheets

SHOCK PAD FOR PAINTBALL POD

This application claims the benefit of Provisional Application No. 60/488,077, filed Jul. 16, 2003.

BACKGROUND

Paintball guns generally utilize top-mounted hoppers that feed ammunition (i.e., paintballs) into the chamber of the paintball gun. The capacity of the paintball gun to continue firing before reloading depends upon the size of the hopper. A larger hopper carries more paintballs, which permits longer use before reloading. However, a smaller hopper is lighter, and in a paintball game where opponents attempt to shoot each other, a smaller hopper presents a smaller target. Whether a player chooses a larger hopper or a smaller hopper, a common experience during a paintball game is the need to reload the hopper with paintballs. Accordingly, a player often carries additional paintballs onto the field of play.

The additional paintballs are commonly carried in pods within a harness that may be strapped on like a belt. The pods are capped tubes containing paintballs that can be poured from a pod into the hopper of a paintball gun. U.S. Pat. App. Pub. No. 2002/0059927 further describes some known paintball pods and is hereby incorporated by reference in its entirety.

During the game, the player is often very active, and this agitates the paintballs quite vigorously. The agitation can cause serious problems for the player by increasing the pressure against the paintballs, which may cause the paintballs to crack and leak paint, thereby making the paintballs unusable. The paintballs rattling inside the tube can also pop open the lid of the paintball pods, allowing the paintballs to spill out of the pod. The paintballs are generally rendered useless if soiled in any way.

Consequently, there is a need for a paintball carrying/loading device or pod that is able to safely carry paintballs on the playing field that minimizes the possibility of breakage.

SUMMARY

In accordance with an aspect of the invention, a paintball loading device or pod cushions and dampens the pressure and shock that movements of the player may exact on paintballs that are stored and/or transported in the paintball loading device or pod. A shock-dampening device in a pod applies a light force or pressure on the paintballs when the pod is closed. As the paintballs in the pod are subjected to gravity, inertia, and forces of physical movement when carried, the shock-dampening device compresses and decompresses in response to the weight of and other forces on the paintballs. The dampening device creates and fills space, dispersing forces that might otherwise break the paintballs in the pod. The paintball loading device or pod thus decreases the chance of paintball breakage.

In one embodiment of the invention, a paintball loading device includes a tube, a lid, and one or more shock absorbing or dampening cushions. The cushions can be is affixed to one or both ends of the storage pod and can be constructed of a soft material such as gel, gelatin, foam, silicone, polyurethane rubber, or sponge.

The loading device as described above overcomes many disadvantages of current on-field-storage methods. For example, the loading device can prevent vulnerability by allowing the player to have full use of all of his or her ammunition.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1A:
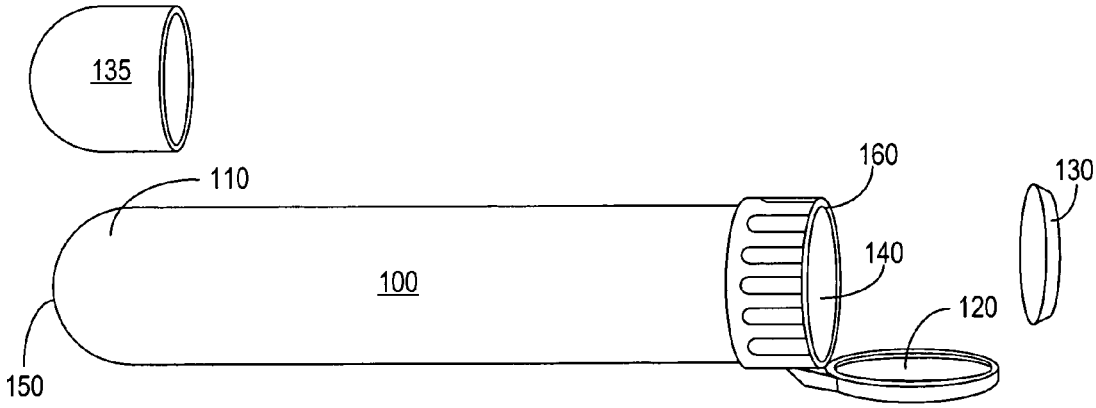
FIGS. 1A and 1B are side perspective views of a paintball loading device in accordance with an embodiment of the present invention and respectively show the device with paintball cushions or shock pads removed and in place.

In accordance with an aspect of the invention, a device for carrying paintballs and loading paintballs into a paintball gun includes one or more cushions that help avoid agitation and breaking of paintballs during vigorous movement. FIG. 1A shows a paintball loading device 100 in accordance with an embodiment of the invention that includes storage tube 110, a lid 120, and shock pad/cushions 130 and 135.

Storage tube 110 is a hollow tube having an opening 140 and a closed end 150. In a preferred embodiment, tube 110 is constructed of clear plastic such as polypropylene, to allow a user to visually determine whether paintball loading device 100 is full or empty. However, tube 110 may also be constructed of opaque plastic or any other material of similar weight and strength. Furthermore, in a preferred embodiment, tube 110 is sized to hold enough paintballs to fill a standard hopper (e.g., to hold 100 to 140 paintballs). Tube 110 can be, for example, about 11 inches long and 3 to 4 inches in diameter.

In an exemplary embodiment of the invention, lid 120 is part of a hinged piece that is separate from tube 110 and can be made molded of a material such as polyethylene. The molded piece including lid 120 can be pressed or glued onto tube 110. A small lip 160 on the opening end of tube 110 or on the hinged piece holds lid 120 in place when lid 120 is closed.

Cushions 130 and 135 are shock absorbing/dampening devices that contain a pressure sensitive material or soft material such as gel, gelatin, foam, silicone, polyurethane rubber, or sponge. The size (e.g., thickness) of cushions 130 and 135 will generally depend on the material used, but in an exemplary embodiment, each cushion 130 or 135 includes foam rubber that is about 1 inch thick.

Figure 1B:
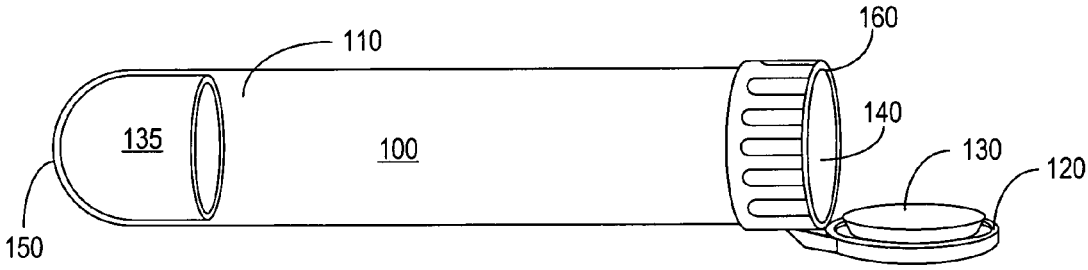

As illustrated in FIG. 1B, cushion 130 can be glued, for example, using a modified acrylic resin, or otherwise fastened on lid 120 to permanently attach cushion 130 to lid 120. Cushion 135 can be similarly affixed to the closed end 150 of tube 110. Alternatively, only one cushion 130 or 135 one on lid 120 or at closed end 150, can be used. Also, the cushion or cushions 130 and 135 could be removable to simplify replacement or cleaning of cushions 130 and 135 and tube 110.

Figure 2:
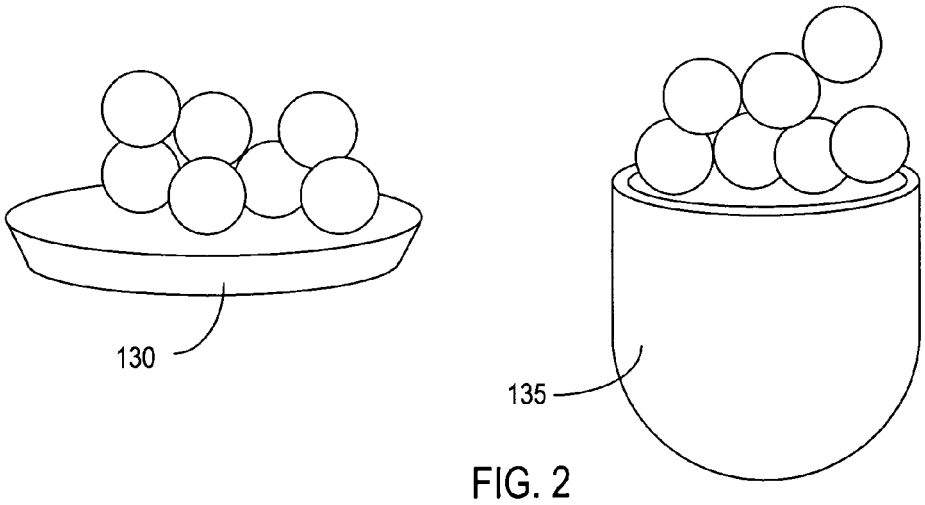
FIG. 2 is a close up perspective view of a paintball cushions or shock pads in accordance with an embodiment of the present invention.

FIG. 2 shows a close-up view of an embodiment of the cushions 130 and 135. As noted above, cushions 130 and

135 contain a material that yields, so that cushions 130 and 135 yield when the paintballs sit or press against cushions 130 and 135. Cushions 130 and 135 may further have features such as a shape (e.g., a concave shape) or variable density (e.g., with a lowest density material contacting the paint balls) that increase the ability of cushions 130 and 135 to decrease the pressure on the paintballs caused by the inertia of the paintballs when the pod is accelerated.

Figure 3A:
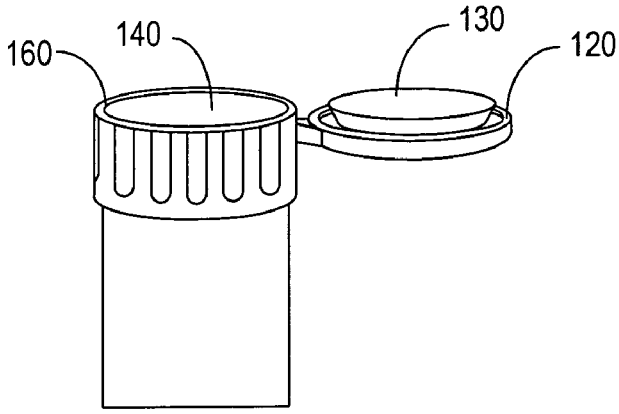
FIG. 3A is a perspective view of the lid with the cushion or shock pad affixed on the paintball loading device in accordance with an embodiment of the present invention.

FIG. 3A shows a close-up view of lid 120 with cushion 130 attached. Lid 120, as illustrated, has a hinge and is spring-loaded so that lid stays open when flipped open, for example, for loading paintballs from tube 110 into the hopper of a paintball gun or when loading paintballs into tube 110 for carrying onto the field of play. Lid 120 also stays closed when closed to engage the lip 160 of tube 110.

Alternatively, lid 120 can be completely removable and either snapped or screwed onto tube 110 or a molded piece attached to tube 110. In such cases, cushion 130 can still be mounted on lid 120 to prevent breaking or rattling of paintballs in tube 110 during vigorous movement.

Figure 3B:
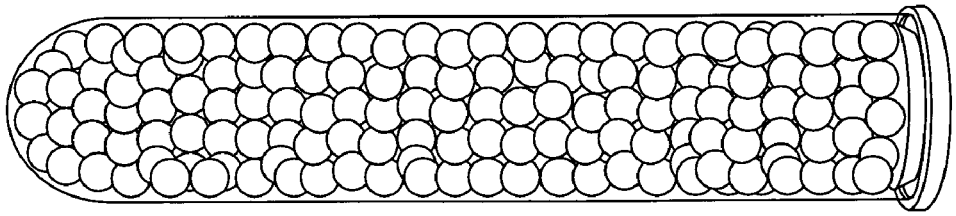
FIG. 3B is a perspective view of the paintball loading device when filled with paintballs.

FIG. 3B shows a paintball loading device when the lid is closed and the loading device is filled with paintballs. As noted above, cushions 130 and 135 can reduce free movement of the paintball, thereby decreasing the velocity of the paintballs relative to tube 110, lid 120, and the other elements of paintball loading device 100.

Although the invention has been described with reference to particular embodiments, the description is only an example of the invention's application and should not be taken as a limitation. Various adaptations and combinations of features of the embodiments disclosed are within the scope of the invention as defined by the following claims.

What is claimed is:

1. A paintball loading device, comprising:

a tube containing a plurality of loose paintballs, a lid capable of sealing the tube; and a cushion that fits within the tube and acts to prevent breakage of the paintballs.

2. The device of claim 1, wherein the cushion attaches to the lid.

3. The device of claim 2, further comprising a second cushion attached to a closed end of the tube.

4. The device of claim 1, wherein the cushion attaches to a closed end of the tube.

5. The device of claim 1, wherein the cushion comprises a material selected from a group consisting of gel, gelatin, foam, silicone, polyurethane rubber, and sponge.

6. The device of claim 1, wherein the cushion fills space at an end of the tube and limits motion of the paintballs relative to the tube and the lid.

7. The device of claim 1, further comprising a hinge structure that attaches the lid to the tube and permits opening of the lid for loading of paintballs without detaching the lid from the tube.

8. The device of claim 7, further comprising a spring mechanism that operates to hold the lid in an open position when the lid is opened and to hold the lid in a closed position when the lid is closed.

9. The device of claim 7, wherein the hinge structure includes a lip that engages and holds the lid in a closed position.

10. The device of claim 9, wherein the tube is clear.

11. The device of claim 1, wherein the cushion is positioned to permit viewing through the tube to determine whether paintballs are within the tube.

12. The device of claim 1, wherein the tube includes a lip on an open end of the tube that engages and holds the lid in a closed position.

13. A paintball loading device, comprising:

a tube;

a lid capable of sealing an open end of the tube;

a first cushion that fills a closed end of the tube; and a second cushion attached to the lid, wherein:

a space in the tube between the first and second cushions accommodates a plurality of loose paintballs; and the first and second cushions act to prevent agitation and breakage of the loose paintballs.

14. The device of claim 13, wherein the tube is clear and permits viewing of paintballs through walls of the tube.

15. A method comprising:

pouring paintballs into a pod that comprises a tube sized to receive the paintballs, a lid capable of sealing the tube, and a cushion that fits within the tube and acts to prevent breakage of the paintballs; and carrying the pod containing the paintballs onto a field of use.

16. The method of claim 15, further comprising pouring paintballs from the tube into a hopper of a paintball gun.

17. The method of claim 15, wherein:

the cushion is at one end of the tube;

the pod further comprises a second cushion at an opposite end of the tube; and the paintballs in the tube reside between the cushions, the cushions protecting the paintballs from shock resulting while the pod is carried.

18. The method of claim 17, further comprising viewing through transparent walls of the tube to determine whether the pod contains paintballs.

* * * * *